United States Patent [19]

McKie

[11] Patent Number: 4,989,782

[45] Date of Patent: Feb. 5, 1991

[54] RAIL AND TRACK

[76] Inventor: Peter S. McKie, 7 Quirk Street, Rozelle, New South Wales 2039, Australia

[21] Appl. No.: 291,596

[22] Filed: Dec. 29, 1988

[30] Foreign Application Priority Data

Dec. 29, 1987 [AU] Australia ..... 83113/87

[51] Int. Cl.[5] ..... E01B 23/04

[52] U.S. Cl. ..... 238/10 R; 238/33; 238/105; 238/122; 238/179

[58] Field of Search ..... 238/122, 151, 166, 168, 238/169, 175, 177, 179, 180, 181, 182, 183, 184, 225, 226, 246, 263, 243, 245, 246, 249, 254, 260, 261, 263, 42, 45, 46, 105, 31, 32, 33, 34, 38, 39, 52, 53, 13, 10 R 27, 28, 149; 403/297, 292, 296

[56] References Cited

U.S. PATENT DOCUMENTS

| | | | |
|---|---|---|---|
| 1,055,253 | 3/1913 | Benzel | 238/179 |
| 1,093,708 | 4/1914 | Lieber et al. | 238/10 R |
| 1,107,116 | 8/1914 | Schaffer | 238/105 |
| 1,152,417 | 9/1915 | Karpowicz | 238/53 |
| 1,229,900 | 6/1917 | Davenport | 238/179 |
| 1,281,451 | 10/1918 | Whitcraft | 238/10 R |
| 2,997,317 | 8/1961 | Scott | 403/297 |
| 3,441,253 | 4/1969 | Blum et al. | 403/297 |
| 3,547,475 | 12/1970 | Gingher | 403/297 |
| 3,620,558 | 11/1971 | MacMillan | 403/297 |
| 3,854,831 | 12/1974 | Gutner | 403/292 |
| 3,884,002 | 5/1975 | Logie | 403/292 |
| 3,966,342 | 6/1976 | Moriya | 403/297 |
| 4,435,103 | 3/1984 | Becker et al. | 403/292 |

FOREIGN PATENT DOCUMENTS

| | | | |
|---|---|---|---|
| 566856 | 12/1932 | Fed. Rep. of Germany | 238/10 R |
| 1192878 | 5/1965 | Fed. Rep. of Germany | 403/297 |
| 2403832 | 8/1975 | Fed. Rep. of Germany | 403/297 |
| 1529556 | 5/1968 | France | 403/292 |
| 022832 | of 1907 | United Kingdom | 238/10 R |
| 576547 | 4/1946 | United Kingdom | 403/292 |
| 0003030 | 6/1954 | United Kingdom | 238/179 |
| 0000852 | 9/1957 | United Kingdom | 238/249 |

*Primary Examiner*—Robert P. Olszewski
*Assistant Examiner*—Mark T. Le

[57] ABSTRACT

A rail for a track for a wheeled vehicle is generally elongated and has a substantially "I" transverse cross section providing an upper rail head and a lower rail foot joined by a web. The rail head is provided with at least one and preferably two laterally spaced apart longitudinally extending apertures, which are adapted to receive alignment pins so that when the rails are coupled to each other substantially end on end, the pins extend between abutting ends of the rails to maintain the rails in an abutting and substantially aligned relationship. A track is also provided including spaced apart rails with a plurality of spacers extending between the spaced apart rails to maintain the rails in a predetermined spaced apart relationship. The spacers can be pivotally mounted on the rails, so that the rails are able to move and pivot relative to each other such as for the adjustment of gauge, packaging, and transport. The track can be used with rails which are substantially parallel to one another or with rails which are of a generally arcuate or curved configuration relative to each other.

17 Claims, 3 Drawing Sheets

RAIL AND TRACK

BACKGROUND TO THE PRESENT INVENTION

The present invention relates to rails for forming tracks upon which a wheeled vehicle may pass, and to tracks which are so formed. The invention has particular but not exclusive application to tracks known as "dolly" tracks, which are used to support wheeled trolleys or vehicles such as are, for example, used in the entertainment business, to support cameras and sometimes operators therefor.

Up until this time, the rails and tracks for such trolleys have been formed of a fabricated steel material, and have been provided in demountable sections, each section principally consisting of a length of metal tubing provided with brackets which engage base sleepers, which support the track. Further, tracks are known in which rail portions are mounted on sleepers, the sleepers being provided underneath or below the base portions of the track.

The above known systems, have numerous disadvantages. One disadvantage is that the tubing generally has insufficient strength to support the trolley as required. Further, as there is considerable length between supporting sleepers, known tracks will often bend due to the weight of the trolley, camera and operator. In known systems, sections are joined one to the other in a substantially end-to-end abutting relationship, and are for example held in such a relationship by turnbuckles extending between engagement means provided adjacent ends of each adjoining section. It has been found that such joins will often distort as the turnbuckles are tightened, due to the unsatisfactory end-to-end relationship between the adjoining sections and due to the fact that the sleepers are provided underneath the rails. Thus, as pressure is applied to the turnbuckles, the rails tend to be drawn up and distortion occurs.

Where such rails and tracks are used, for example, in the entertainment business, it is often necessary that they be transported from place to place. It is therefore advantageous that in some aspects, the rails and tracks be able to be folded and thereafter transported and stored in a compact manner. Available and known tracks do not always meet these needs.

It is an object of this invention to go some way towards overcoming and at least minimizing the above problems.

Other objects of this invention will become apparent from the following description.

BRIEF SUMMARY OF THE PRESENT INVENTION

According to one aspect of this invention there is provided a rail for a track upon which a wheeled vehicle is to pass, said rail being generally elongated and having a substantially "I" transverse cross section, such as to provide an upper rail head and a lower rail foot joined by a web; wherein said rail head is provided with at least one longitudinally extending aperture, adapted to receive at least part of an alignment pin, so that in use, and upon said rail being coupled to a substantially corresponding and co-operating rail, said pin extends between abutting ends of said rails such as to maintain said rails in an abutting and substantially aligned relationship.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE ACCOMPANYING DRAWINGS

The present invention will now be described by way of example only, with reference to the accompanying drawings which are given by way of illustration only, and thus are not limitative of the present invention, and wherein:

FIG. 1: is a schematic perspective view of a track including rails according to one form of the present invention;

FIG. 2: is a schematic side elevational view of a portion of a rail according to one form of the present invention;

FIG. 3: is a schematic plan view of a track as shown in FIG. 1 of the accompanying drawings, and showing the ability to have the track formed into a folded configuration; and FIG. 4: is a schematic plan view of the track of FIG. 1 in a partly folded position, such as to provide an alternative gauge to that shown in FIG. 1.

DESCRIPTION OF THE PREFERRED EMBODIMENTS OF THE INVENTION

Figure 1:
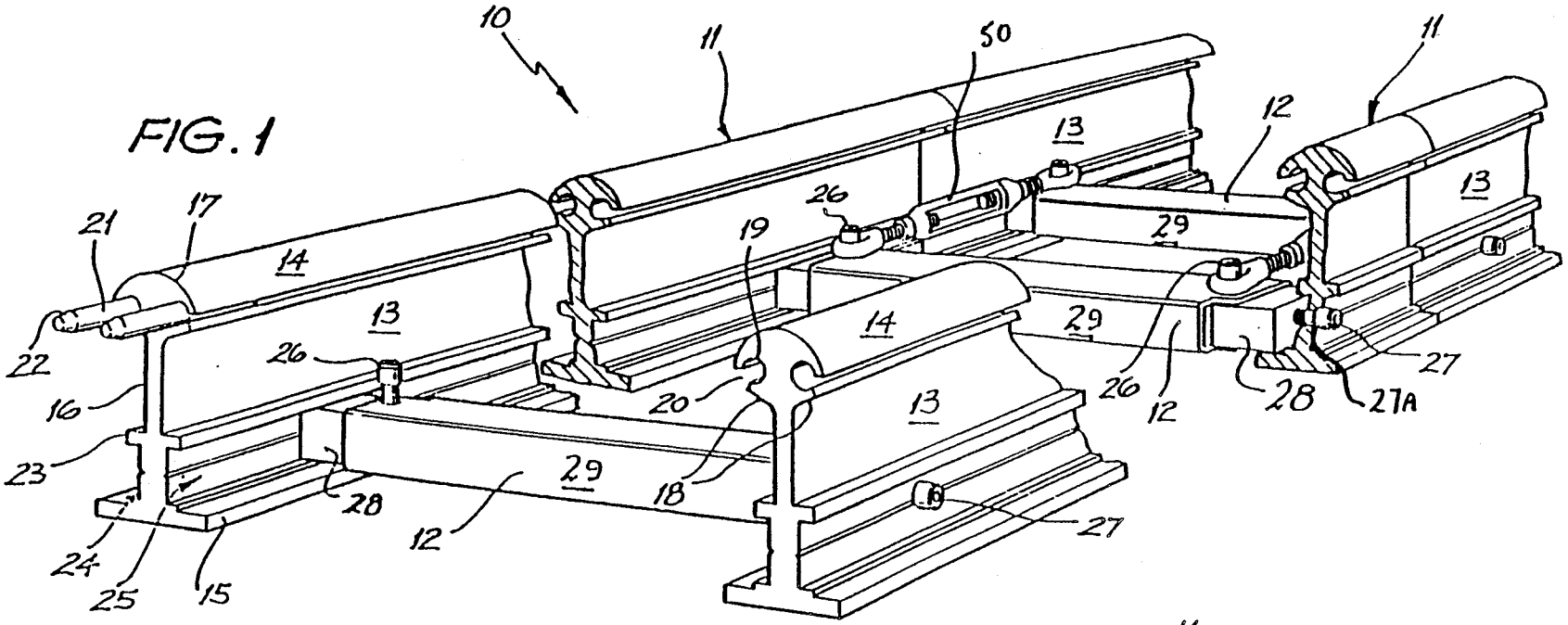

Referring to FIG. 1 of the accompanying drawings, a track 10 is shown, which consists of two co-extensive rails 11, which are laterally spaced apart one from the other by a distance sufficient to establish the desired gauge of the track. The rails 11 are held in the desired spaced relationship by means of elongate spacers 12.

The rail members 13, which are joined end on end to form said rails 11, are formed of a generally "I" transverse cross section and are generally elongated in formation, having an upper rail head 14 and a lower rail head 15 joined by a web 16. The rail members 13 are preferably formed from a metal material and are integrally formed. The rail head 14 preferably has an upper curved surface 17, to engage with the wheels of a vehicle or trolley. The head 14 is also provided with substantially inclined and downwardly facing surfaces 18. These surfaces 18 will engage one or more wheels provided on a trolley to prevent a wheel which engages the surface 17 from lifting away from the surface 17, as would occur if the trolley was tilting or angled.

The rail head 14 is provided with at least one elongate aperture therein, so that when substantially corresponding rails abut and engage one to the other, one or more alignment pins 21 can engage within said apertures, so as to locate and align said rails one with the other.

In the preferred form of the invention as shown in the accompanying drawings, the rail head 14 is provided with two elongate apertures 19, which are laterally spaced apart one from the other and which have open faced slots 20, provided at each side of the rail head 14.

Figure 2:
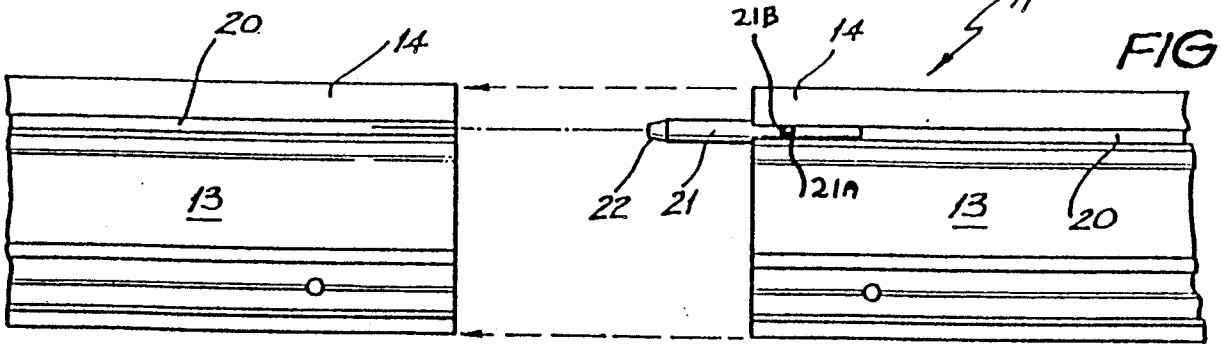

Alignment pins 21 are provided, so that an alignment pin will engage within corresponding apertures 19. The alignment pins 21 are elongate and tubular and, when engaged within corresponding apertures, ensure that the rail members 13 are in alignment while reinforcing the join therebetween. In a preferred form of the invention the alignment pins 21 are of a press or friction fit, or can be secured by threaded fastener. The pins 21 may be provided with tapered leading surfaces 22 to facilitate insertion in adjacent rail members 13. Referring to FIG. 2 of the accompanying drawings, a tail portion 21A of an elongated pin 21 can be provided with adjustment means 21B such as for example a screw or grubscrew extending transversely through a hole or bore in the pin substantially transverse to the longitudinal axis of the pin. The arrangement is such that on the pin being located within the aperture and on the screw or grubscrew being tightened, the end of the screw or grub screw will be forced to act on or against an inner surface of the aperture 19, to thus deflect the pin 21 and in particular, the end 22 thereof outwardly of the aperture and relative to the longitudinal axis of the aperture. This will allow for a positive engagement between the ends of rail members 13 and will prevent loosening of the connection and, at the same time will minimize or prevent as far as possible, downward deflection of the pin. Thus, the adjustability of the orientation of the pin 21, within and relative to the aperture, and relative to the longitudinal axis of the rail, will assist in a positive location between the rail members 13, such that the pin 21 will be positively held and located in position within apertures 19 of adjacent and abutting ends of rail members 13. Further, such a positive engagement will minimize or avoid the collection of dust, extraneous matter and the like.

The web 16 of each rail member 13 is provided with a longitudinally extending flange 23, such that a longitudinally extending recess 25 is defined between a lower or under surface of the flange 23 and an upper surface 24 of the foot 15. As will be appreciated from the description hereinafter, this recess 25 assists in the secure location of the ends of spacers 12, which extend between laterally spaced apart rails.

In one form of the invention a plurality of elongate spacers are provided to form a track, the spacers 12 acting to maintain the rails 11 in a laterally spaced apart relationship, for a distance dependent upon the gauge of the track that is desired. The spacers 12 are elongate in formation having a main body 29, and a depth preferably substantially complementary to the depth of the recess 25. Thus the spacers extend between rails 11, by each end of a spacer 12 engaging within the recess 25 of each rail 11, so that the spacers 12 are located on the upper surface of the foot 15 and below the lower surface of the flange 23. Threaded fasteners 27 are provided and extend through spaced apart bores 27A provided in the web 16. Preferably the bores 27A and fasteners 27 are laterally spaced apart one from the other along the length of the web and within the recess 25.

The spacers 12, by being so engaged between the rails 11, (each rail 11 being formed of a plurality of engaged and abutting rail members 13), maintain the rails 11 in a desired and laterally spaced apart relationship one from the other.

The number of spacers 12 extending between rail members, depends upon the length of the rail members that are to be joined together to form the rails. The spacers 12, at or adjacent each end of a rail member 13 are provided with upwardly extending fasteners or lugs 26, turnbuckles 50 are provided, so that ends of the turnbuckles 50 will be engaged with or over the fasteners or lugs 26, to be thereafter secured or tightened into position, so as to securely hold the rail members 13 in juxtaposition and abutment one with the other.

It has been found to be a substantial advantage with the present invention, that the spacers 12 are located and secured on the upper surface 24 of the foot 15, as when pressure is applied to the turnbuckles 50, such pressure does not cause distortion as has been the case in known arrangements, where spacing members or similar arrangements have been provided on a lower surface of the rail.

Figure 3:
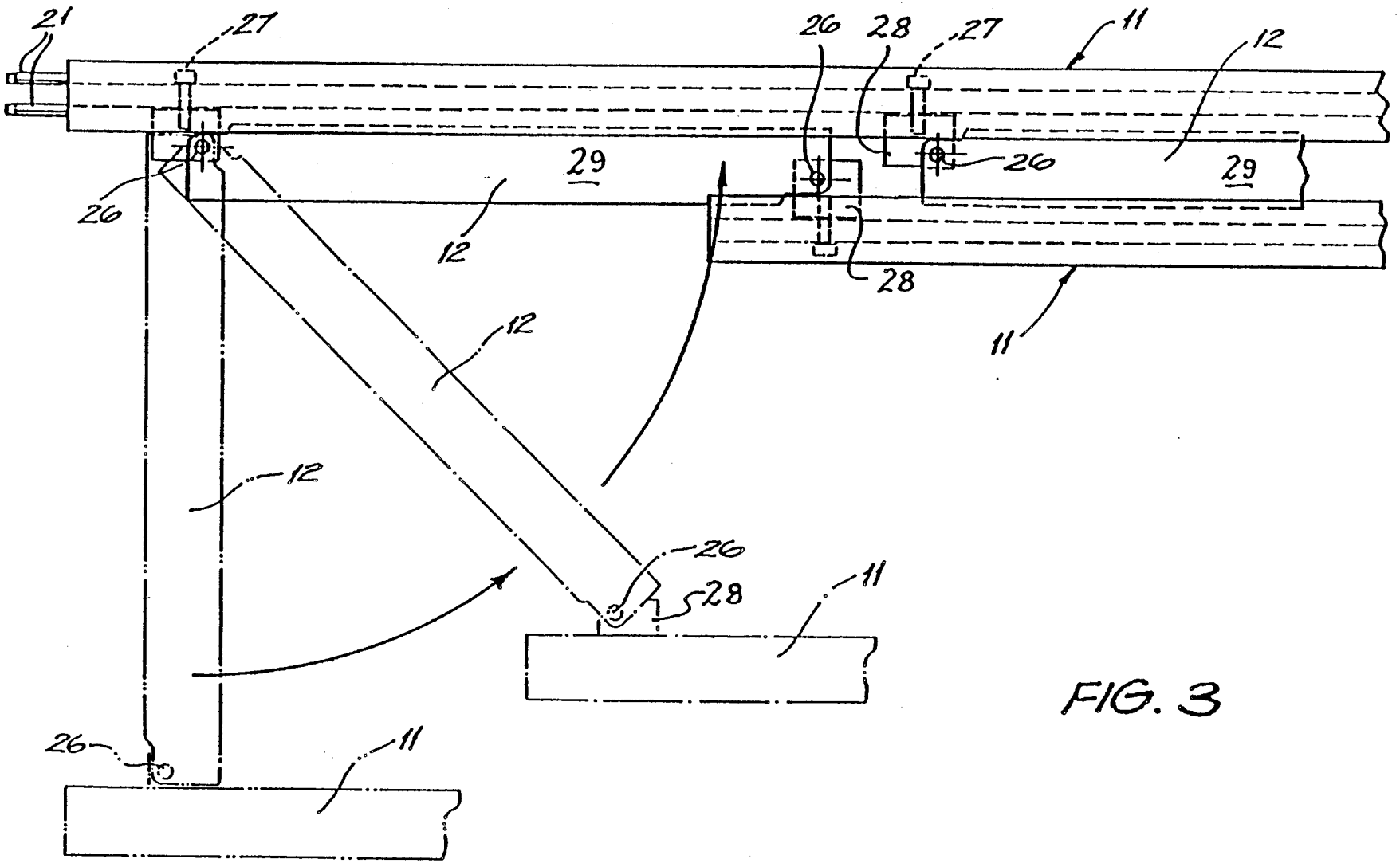

In the form of the invention shown in the accompanying drawings, the spacers 12 are of an articulated or pivotal constructions, which allows for the folding of a track 10, such as, for example, for storage or transport purposes. This is shown with particular reference to FIGS. 3 and 4 of the accompanying drawings. Thus in one preferred form of the invention, ends of each spacer 12 are formed or stepped mounting blocks 28 being secured to the rail members 13, within the recess 25, by threaded fasteners 27, using the bores 27A provided in the webs 16. The spacers 12 are provided with a flange or stepped end portion which is pivotally attached to the mounting blocks 28, by an elongated fastener 26, which will also extend upwardly from the upper surface of the spacer 12 and block 28. This means that each end of the spacer 12 is pivotally attached to a rail member 13, such that when a plurality of rail members 13 are connected together on each side of the track, the so formed rails 11 are able to pivot or angle towards or away from one another, such as for transport, storage or the like. Turnbuckles 50 are extended between the fasteners 26, at or adjacent each end of a rail member 13, where the rail members 13 are being joined one to the other and the tightening of said turnbuckles 50 will again maintain the rail members 13 in face to face abutment in a secure and aligned manner.

Figure 4:
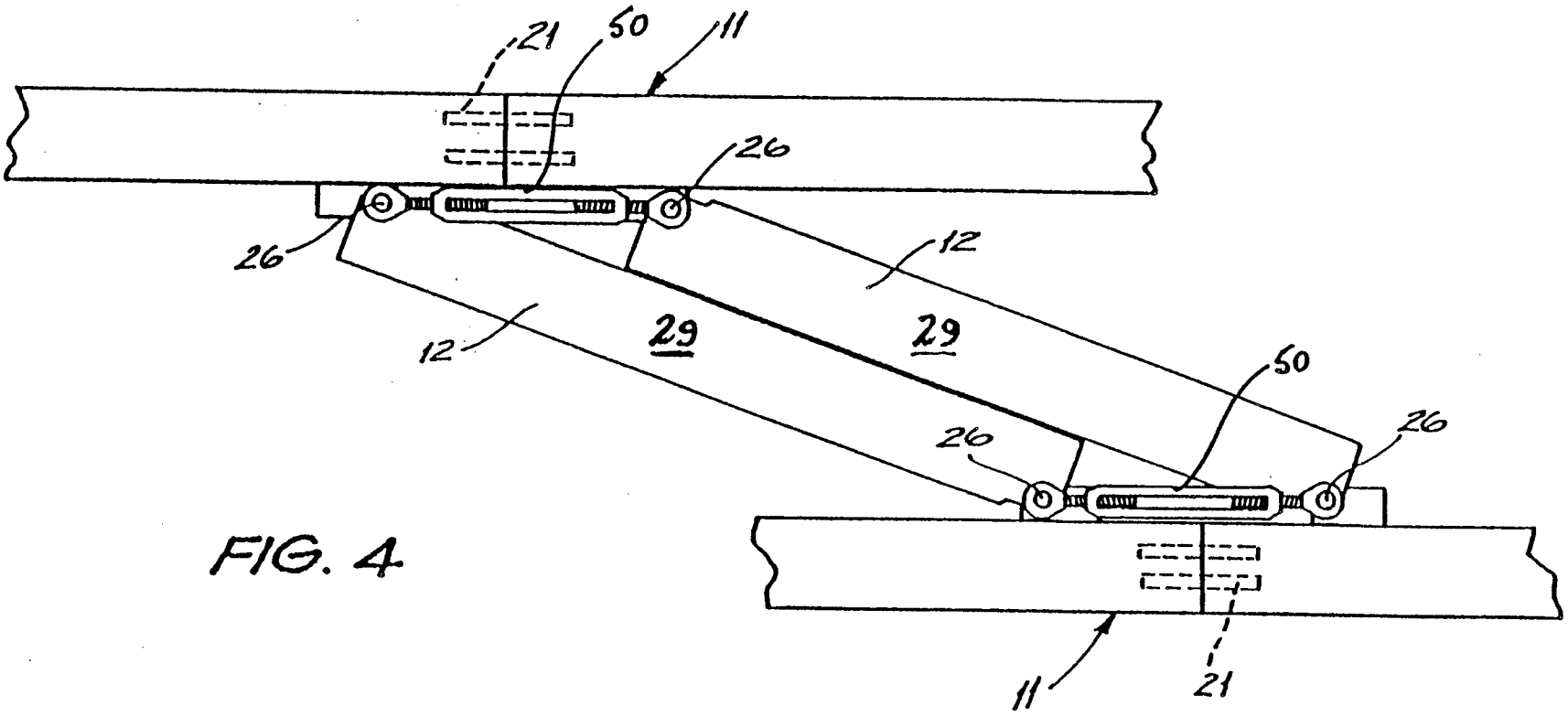

As shown by way of example in FIG. 4 of the drawings, the pivotal attachment of the spaces 24 can also be used to adjust the gauge between the rails 11 of a track 10.

The present invention has been described by way of example only, and with reference to the accompanying drawings, with reference to a track in which the rails 11 are laterally spaced apart, and extend substantially longitudinally and parallel one to the other. It should be appreciated however, that the invention has equal application to the attachment of curved or arcuate rails and rail members on to the other, and the formation of arcuate tracks (such as for use with corners, circles and the like), where two spaced apart arcuate rails 11 are connected in the same manner as that described hereinbefore.

It should be appreciated that the rail members of the present invention can be formed of any appropriate material, although in preferred forms of the invention the rail members are formed of a metal, aluminium or rolled metal section. The rails can however be formed of a plastics or reinforced plastics material.

In the embodiments hereinbefore described, the rail members have a general transverse cross section such that an initial moment of inertia about a horizontal axis extending generally transverse of the rail member 13, is considerably greater than the initial moment of inertia about a vertical axis extending normal to the rail lengths. This facilitates the rail members 13 following an arcuate or curved path, while still providing each rail member with sufficient strength to accommodate vertical loads. Improvements and modifications may be made to the present invention without departing from the scope or spirit thereof and all such improvements and modifications as would be obvious to one skilled in the art are intended to be included within the scope of the following claims.

I claim:

1. A track for a wheeled vehicle, comprising a pair of rails, each rail being elongated and having a substantially "I" transverse cross section, each of said rails having an upper rail head and a lower rail foot joined by a web, each of said rail heads having at least two laterally spaced apart apertures to receive alignment pins to couple and engage a plurality of rails one to the other with aperture pins extending between abutting ends of said rails to maintain said rails in an abutting and aligned relationship, at least one spacer being provided for each of the pair of rails, said at least one spacer extending between said pair of rails, the at least one spacer being pivotally secured to each of said rails in the pair to allow relative movement between said rails in the pair toward and away from each other, said track further comprising a flange on said web, said flange extending outwardly from said web, and wherein ends of said at least one spacer are secured to said rails within a recess defined by an upper surface of the rail foot and an underside of the flange.

2. The track as claimed in claim 1, wherein said at least one spacer is pivotally attached to an upper surface of the rail foot.

3. The track as claimed in claim 1, wherein ends of said at least one spacer for each pair of rails are provided with fastener means for engaging turnbuckles between said fasteners.

4. The track as claimed in claim 1, wherein said rails of the pair are held in a substantially parallel relationship one to the other.

5. The track as claimed in claim 1, wherein said rails are of one of a generally arcuate formation and curved formation.

6. The track as claimed in claim 1, further comprising means for adjusting engagement of said pins within said apertures.

7. A rail for a track upon which a wheeled vehicle is to pass, said rail being generally elongated and having a substantially "I" transverse cross section, said rail having an upper rail head and a lower rail foot joined by a web, said rail head having at least one longitudinally extending aperture defined therein, said at least one aperture having a longitudinally extending slot in an outer side surface thereof, said slot extending the length of said aperture, such that said at least one aperture is open-faced along the outer side thereof, said at least one aperture receiving at least part of an alignment pin to couple said rail to a corresponding rail, one end of said rail abutting an end of said corresponding rail when the rails are coupled, said alignment pin including adjustment means for adjusting positioning of said pin relative to the longitudinal axis of said aperture in said rail, said pin extending between the abutting ends of said rail and corresponding rail to maintain the rails in an abutting and aligned relationship.

8. The rail as claimed in claim 7, wherein the rail head is provided with two laterally spaced apart apertures.

9. The rail as claimed in claim 7, wherein two laterally spaced apart apertures are provided in said upper rail head, said apertures being provided one on each side of said rail head.

10. The rail as claimed in claim 7, wherein at least one longitudinally extending flange is provided between said upper rail head and said lower rail foot, said flange and rail foot defining a recess therebetween.

11. The track as claimed in claim 10, wherein at least one spacer is provided for each of the pair of rails, said at least one spacer extending between said pair of rails and being pivotally secured to each of said rails in the pair to allow relative movement between said rails in the pair toward and away from each other.

12. The track as claimed in claim 11, further comprising a flange on said web, said flange extending outwardly from said web, and wherein ends of said at least one spacer are secured to said rails within a recess defined by an upper surface of the rail foot and an underside of the flange.

13. The track as claimed in claim 11, wherein said at least one spacer is pivotally attached to an upper surface of the rail foot.

14. The track as claimed in claim 11, wherein ends of said at least one spacer for each pair of rails are provided with fastener means for engaging turnbuckles between said fasteners.

15. A track for a wheeled vehicle, comprising a pair of rails, each rail being elongated and having a substantially "I" transverse cross section, each of said rails having an upper rail head and a lower rail foot joined by a web, each of said rail heads having at least two laterally spaced apart apertures defined therein, said two apertures each having a longitudinal axis and each receiving an alignment pin to thereby couple and engage a plurality of rails one to the other with the alignment pins extending between abutting ends of said rails which are in an abutting and aligned relationship, said alignment pins including adjustment means for adjusting positioning of said pins relative to the longitudinal axes of the apertures in said rail, each aperture having a longitudinally extending slot in an outer side surface thereof, said slots extending the length of said apertures such that said apertures are open-faced along the outer sides thereof.

16. The track as claimed in claim 15, wherein said rails of the pair are held in a substantially parallel relationship one with the other.

17. The track as claimed in claim 15, wherein said rails are of a generally arcuate and curved formation.

* * * * *